US009040946B2

(12) United States Patent
Ripert et al.

(10) Patent No.: US 9,040,946 B2
(45) Date of Patent: May 26, 2015

(54) THERMAL-CONDUCTION ELEMENT FOR IMPROVING THE MANUFACTURE OF A PACKAGE FOR TRANSPORTING AND/OR STORING RADIOACTIVE MATERIALS

(75) Inventors: Herve Ripert, Paris (FR); Emmanuel Mercier, Athis Mons (FR); Sylvain Lauret, Chatillon (FR)

(73) Assignee: TN INTERNATIONAL, Montigny le Bretonneux (FR)

( * ) Notice: Subject to any disclaimer, the term of this patent is extended or adjusted under 35 U.S.C. 154(b) by 0 days.

(21) Appl. No.: 14/111,598

(22) PCT Filed: Mar. 30, 2012

(86) PCT No.: PCT/EP2012/055776

§ 371 (c)(1),
(2), (4) Date: Oct. 14, 2013

(87) PCT Pub. No.: WO2012/143224

PCT Pub. Date: Oct. 26, 2012

(65) Prior Publication Data

US 2014/0035196 A1 Feb. 6, 2014

(30) Foreign Application Priority Data

Apr. 18, 2011 (FR) ..... 11 53329

(51) Int. Cl.

| | |
|---|---|
| ***G21F 5/00*** | (2006.01) |
| ***G21F 5/10*** | (2006.01) |
| ***F28F 3/00*** | (2006.01) |
| *G21F 5/008* | (2006.01) |

(52) U.S. Cl.
CPC . *G21F 5/10* (2013.01); *G21F 5/008* (2013.01); *F28F 3/00* (2013.01)

(58) Field of Classification Search
USPC ..... 250/505.1, 506.1, 507.1, 515.1, 518.1
See application file for complete search history.

(56) References Cited

U.S. PATENT DOCUMENTS

| | | | | |
|---|---|---|---|---|
| 4,590,383 | A | 5/1986 | Machado et al. | |
| 2004/0062338 | A1 | 4/2004 | Ohsono et al. | |
| 2009/0114856 | A1 * | 5/2009 | Shimojo et al. | 250/506.1 |
| 2010/0272225 | A1 * | 10/2010 | Singh | 376/272 |
| 2011/0122985 | A1 * | 5/2011 | Tamaki | 376/272 |

FOREIGN PATENT DOCUMENTS

EP 0087350 A1 8/1983

OTHER PUBLICATIONS

International Search Report of PCT/EP2012/055776 dated Jul. 11, 2012.

* cited by examiner

*Primary Examiner* — Nicole Ippolito
(74) *Attorney, Agent, or Firm* — Pearne & Gordon LLP

(57) ABSTRACT

The invention relates to a thermal conduction element (20) for a package for transporting and/or storing radioactive materials, comprising:

an internal part (30) intended to be in contact with a lateral body (14) of the package;

an external part (34) intended to form a portion of an external envelope (24) of said package, holding radiological protection means (22);

an intermediate part (32) arranged between the internal and external parts, the internal, external and intermediate parts being produced from copper and one of the alloys thereof.

According to the invention, the external part (34) is equipped, at each of its two opposite ends, with an area (36) for connection by welding to another thermal conduction element (20), each connection area (36) being produced from steel.

13 Claims, 10 Drawing Sheets

THERMAL-CONDUCTION ELEMENT FOR IMPROVING THE MANUFACTURE OF A PACKAGE FOR TRANSPORTING AND/OR STORING RADIOACTIVE MATERIALS

TECHNICAL FIELD

The present invention relates to the field of the transport and/or storage of radioactive materials such as nuclear fuel assemblies, unused or irradiated.

Preferably, the invention concerns a package of radioactive materials of the type comprising thermal-conduction elements arranged in contact with a lateral body and delimiting in pairs cavities filled with radiological protection blocks, in particular intended to form an effective barrier against neutrons.

PRIOR ART

Conventionally, in order to provide the transport and/or storage of nuclear fuel assemblies, storage devices, also referred to as storage "baskets" or "racks", are used. These storage devices, usually cylindrical in shape and with a substantially circular cross-section, have a plurality of adjacent housings each able to receive a nuclear fuel assembly. The storage device is intended to be housed in the housing cavity for a package in order to form conjointly therewith a container for transporting and/or storing nuclear fuel assemblies, in which the radioactive material is perfectly confined.

The aforementioned housing cavity is generally defined by a lateral body extending in a longitudinal direction of the package, this lateral body being for example formed by a metal barrel.

The lateral body is surrounded by a plurality of thermal conduction elements contacting it. In addition, radiological protection blocks are arranged between these conduction elements, in particular to form a barrier against the neutrons emitted by the fuel assemblies housed in the cavity.

More precisely, each thermal conduction element comprises an internal part intended to be in contact with the lateral body of the package and an external part intended to form a portion of an external envelope of the package, this external portion holding the protection blocks in the external radial direction. Furthermore, an intermediate part is arranged between the internal and external parts in order to hold them with respect to each other. These thermal conduction elements are profiles that run over all or part of the length of the package. They generally have a transverse section roughly in the form of a U or S.

Usually, the internal, external and intermediate parts are produced from copper or one of the alloys thereof. When the thermal conduction elements are mounted on the lateral body, the external parts are assembled end to end, by welding their copper ends.

The use of copper-copper welding leads to the obtaining of welds the quality of which is not always easy to guarantee.

In addition, the corrosion resistance of these copper/copper welds is low whereas the package may be subjected to strong corrosive environments, in particular when it is stored on sites exposed to sea air, or during operations of loading spent fuel in the package, when these operations take place under water. The external surface of the multiple welds must therefore undergo treatment capable of conferring an anticorrosion function. It may be the case of the application of a layer of nickel, or of a heat treatment of the HVOF type ("High Velocity Oxygen Fuel Thermal Spray Process"). In either case, the treatment carried out makes the manufacturing process complex, which is detrimental to it in terms of time and cost.

Moreover, for implementing copper-copper welding, preheating of the profiles is required at around 350°-400° C. Such temperatures being liable to degrade the radiological protection material held by the conduction elements to be welded, the fitting of the radiological protection blocks on the package is therefore normally done after the welding of the copper ends. This therefore gives rise to a constraint in sequencing the steps in the method of manufacturing the package. In addition, when the radiological protection material is introduced by pouring into the cavities delimited by the conduction elements already butt welded, from one or other or both of the longitudinal ends of these cavities, a visual check on the quality of the blocks after solidification is extremely difficult to carry out.

DISCLOSURE OF THE INVENTION

The aim of the invention is therefore to remedy at least partially the drawbacks mentioned above relating to the embodiments of the prior art.

To do this, the subject matter of the invention is a thermal-conduction element for a package for transporting and/or storing radioactive materials, comprising:

an internal part intended to be in contact with a lateral body of the package;

an external part intended to form a portion of an external envelope of said package, holding radiological protection means;

an intermediate part arranged between the internal and external parts, the internal, external and intermediate parts being produced from copper and one of the alloys thereof.

According to the invention, said external part is equipped, at each of its two opposite ends, with an area for connection by welding to another thermal conduction element, each connection area being produced from steel.

The invention therefore makes it possible to perform welding operations of the steel-steel type between the external parts of the conduction elements, which confers the following advantages.

First of all, the use of steel-steel welding is less complex and less expensive than that of copper-copper welding. In addition, it leads to the obtaining of welds of much better quality than those obtained with copper-copper welding.

Moreover, in particular when the connection areas are made from stainless steel, it is no longer necessary to proceed with the nickel treatment or heat treatment of the HVOF type of the welds carried out, since the anticorrosion function is provided by the actual nature of the weld. The method for manufacturing the package comprising such thermal conduction elements is simplified thereby, and therefore less expensive.

The design adopted overall facilitates the method of manufacturing the package while keeping the essential nature of these conduction elements away from copper or one of the alloys thereof, in order to be able to fulfil its prime function of transfer of heat to the outside of the package.

The steel-steel welding of the connection areas is generally done at around 180° C., a temperature at which there exist only very low risks of degradation of the radiological protection material held by the conduction elements to be welded. Thus the invention makes it possible not only to eliminate the step of preheating of the thermal conduction elements but also allows the fitting of the radiological protection blocks on the package before the welding of the steel areas. This eliminates the constraint of sequencing of the steps of the method for manufacturing the package encountered in the prior art.

In this regard, since the possibility is offered of fitting the radiological protection blocks before carrying out the steel-steel welding of the ends of the conduction elements, it is also possible to provide the pouring of each block in only one of the two conduction elements that defines the cavity in which the block is to be housed, and then to assemble the second element only after the obtaining of this block. Consequently, before the assembly of this second conduction element, the visual check on the block, when required, proves to be very easy to achieve, over its entire free surface intended to be subsequently covered by this second thermal conduction element.

In such a case, the introduction of the radiological protection material is no longer necessarily done through the longitudinal ends of these cavities. It can in fact take place at several points spaced apart longitudinally at the temporarily open face of the cavity concerned, with the package oriented horizontally, which limits the risks of filling faults.

Preferably, each connection area is produced from carbon steel, or even more preferentially from stainless steel.

Preferably, the thermal conduction element has a transverse section roughly in the form of a U or S.

Preferably, each connection area extends over a circumferential length between 5% and 15% of the circumferential length of its associated external part.

Preferably, the internal, external and intermediate parts are produced in a single piece, or from at least two portions connected by welding.

Another subject matter of the invention is a package for transporting and/or storing radioactive materials, comprising a lateral body as well as a plurality of thermal-conduction elements of the type described above, the internal parts of which are arranged in contact with said lateral body and the external parts of which form a part of said external envelope of said package that holds radiological protection means, said external envelope being supplemented by said connection areas equipping said external parts, as well as by welds connecting these connection areas in pairs.

Preferably, any two directly consecutive thermal conduction elements define, in particular with their welded connection areas, a cavity housing a radiological protection block, preferably produced by pouring or by a prefabricated block.

Another subject matter of the invention is a method for manufacturing a package for transporting and/or storing radioactive materials as described above, comprising, for at least one of said radiological protection blocks, the pouring of a radiological protection material into one of said two thermal conduction elements intended to define the cavity in which said block is intended to be housed, said pouring being carried out with this thermal conduction element assembled on the package.

Preferably, for at least one of said radiological protection blocks, the method comprises the following successive steps:

the pouring of a radiological protection material into one of said two thermal conduction elements intended to define the cavity in which said block is intended to be housed, said pouring being carried out with this thermal conduction element assembled on the package; then the assembly on the package of the other one of said two thermal conduction elements.

As mentioned above, by proceeding in this way, the visual check of the block becomes very easy to achieve, over its entire free surface intended to be subsequently covered by the other thermal conduction element.

In addition, the introduction of the radiological protection material can be done at several points spaced apart longitudinally at the temporarily open face of the cavity concerned, which limits the risks of filling faults.

This particular sequencing of steps is allowed by the possibility of carrying out the butt welding of the construction elements after the formation of the blocks in their cavity, without risk of deterioration of these blocks, because of the steel composition of the connection areas to be welded.

Preferably, said step of assembly on the package of the other one of said two thermal conduction elements comprises the fixing of its internal part on the lateral body, for example by welding or screwing. It also comprises the steel-steel welding, of its dedicated connection area, with the connection area of the first element already fixed to the package and housing the radiological protection block. Alternatively, said step of assembling the other one of said two thermal conduction elements on the package could comprise only the aforementioned steel-steel welding, ensuring that its internal part is only in contact with the lateral body, without being fixed to the latter.

Preferably, said cavities are filled successively, preferably one by one, with said package oriented horizontally, and introducing the radiological protection material from above. This procures great ease of implementation of the method, in particular of its step of pouring the radiological protection material, where the associated risks of filling faults prove to be extremely low.

Various preferred embodiments can then be envisaged.

According to a first preferred embodiment, for at least one of said radiological protection blocks, the pouring of the radiological protection material takes place directly in said one of said two thermal conduction elements intended to define the cavity in which said block is intended to be housed.

Here, the visual inspection after the pouring is very easily achievable, over the entire length of the cavities. Once this inspection has been performed, the cavity is closed by mounting the other one of the two thermal conduction elements on the package.

According to a second preferred embodiment, for at least one of said radiological protection blocks, the pouring of the radiological protection material takes place through at least one orifice provided on a tool mounted above said one of said two thermal conduction elements intended to define the cavity in which said block is intended to be housed, the other one of said two thermal conduction elements being assembled on the package after the removal of said tool.

Here the tool may easily be designed to visually check the correct placing of the radiological protection material in the cavity, for example by means of overflow orifices distributed in the longitudinal direction of the package.

According to a third preferred embodiment, for at least one of said radiological protection blocks, the pouring of the radiological protection material takes place through at least one orifice provided on the intermediate part of said other one of said two thermal conduction elements, mounted temporarily above said at least one of said two thermal conduction elements intended to define the cavity in which said block is intended to be housed, this other one of said two thermal conduction elements then being removed and then reassembled definitively on the package.

The demounting and then the reassembly of the second conduction element makes it possible to carry out, between these two steps, the visual check on the quality of the block. This third embodiment consists simply of replacing the tool of the second mode with the second conduction element.

This third embodiment could alternatively be implemented by effecting the pouring of the radiological protection material through at least one orifice provided on the intermediate part of said other one of said two thermal conduction elements, mounted definitively on the package above said at least one of said two thermal conduction elements intended to define the cavity in which said block is intended to be housed. This alternative is in particular adopted when no visual check on the blocks has to be carried out. This second thermal conduction element therefore no longer needs to be mounted temporarily, demounted and then remounted definitively on the package.

Whatever the embodiment envisaged, the welding of the connection areas in pairs is preferentially carried out after all the radiological protection blocks of the package have been poured in their associated cavity.

Other advantages and features of the invention will emerge in the following non-limitative detailed description.

BRIEF DESCRIPTION OF THE DRAWINGS

This description will be made with regard to the accompanying drawings, among which.

DETAILED DESCRIPTION OF PREFERRED EMBODIMENTS

Figure 1:
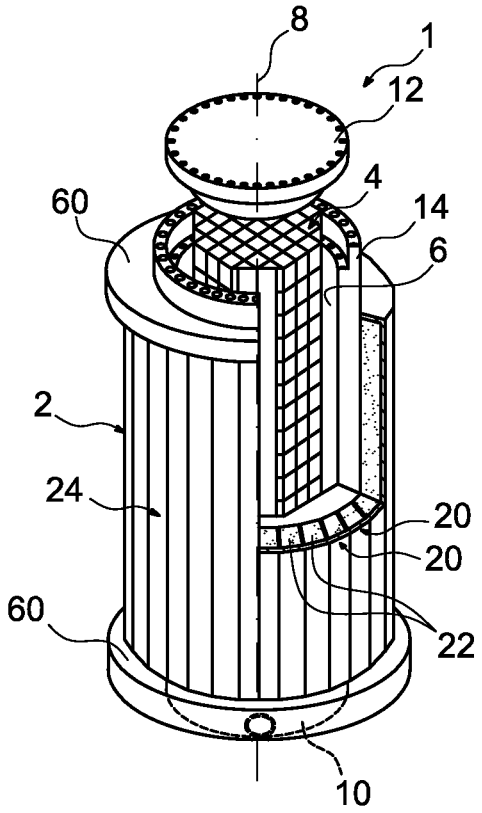
FIG. 1 shows a perspective view of a container for transporting and/or storing nuclear fuel assemblies, comprising a package according to a preferred embodiment of the present invention.

First of all with reference to FIG. 1, a container 1 for transporting and/or storing nuclear fuel assemblies can be seen. In this regard it should be stated that the invention is in no way limited to the transport/storage of this type of nuclear material.

The container 1 comprises overall a package 2 that is the subject of the present invention, inside which there is a storage device 4, also referred to as a storage basket. The device 4 is designed to be placed in a housing cavity 6 of the package 2, as shown by FIG. 1, in which it is also possible to see the longitudinal axis 8 of this package, merged with the longitudinal axes of the storage device and the housing cavity.

Throughout the description, the term "longitudinal" must be understood as parallel to the longitudinal axis 8, and the term "transverse" must be understood as orthogonal to this same longitudinal axis 8.

Conventionally, the storage device 4 comprises a plurality of adjacent housings disposed parallel to the axis 8, these each being able to receive at least one fuel assembly with a square or rectangular cross-section, and preferably only one. The container 1 and this device 4 have been shown in a vertical position of loading/unloading the fuel assemblies, different from the horizontal/supine position normally adopted during the transportation of assemblies.

In general terms, the package 2 first of all has a bottom 10 on which the device 4 is intended to rest in the vertical position, a lid 12, and a lateral body 14 extending around and along the longitudinal axis 8, parallel to the longitudinal direction. The bottom 10 and the lid 12 are thus spaced apart from each other in the longitudinal direction of the package, parallel to the axis 8.

It is this lateral body 14 that defines the housing cavity 6, by means of a lateral internal surface with a substantially cylindrical shape and a circular cross-section, and with its axis merged with the axis 8. The lateral body 14 may take the form of a thick metal barrel, preferably produced from steel.

The bottom 10, which defines the bottom of the cavity 6 open at the lid 12, may be produced in a single piece with at least part of the lateral body 14, without departing from the scope of the invention.

The package 2 also comprises, surrounding and contacting the external surface of the lateral body 14, a plurality of thermal conduction elements 20 extending radially outwards, as well as along a major part of the length of this body 14, in the direction of the axis 8.

The elements 20 are profiles specific to the present invention, which will be detailed below with reference to the following figures. They make it possible to discharge the heat given off by the fuel assemblies present in the storage basket 4, to the outside of the package.

They also participate in the housing and holding of the radiological protection blocks 22, essentially designed to form a barrier against neutrons. The blocks are preferably obtained by pouring, as will be disclosed below, and produced from any material judged to be suitable by a person skilled in the art, such as a resin.

The thermal conduction elements 20 also participate in forming an external envelope 24 of the package, centred on the axis 8. In addition, although this has not been shown, this envelope may be equipped with fins promoting heat exchangers with the surrounding air.

The package is also provided with damping caps (not shown) covering respectively the lid 12 and the bottom 10 of this package, as well as two damping rings 60 surrounding the lateral body 14, and arranged respectively at the longitudinal ends of the profiles 20 and blocks 22. These rings 60 project radially towards the outside with respect to the envelope 24 in order to constitute favoured impact areas in the event of accidental fall, when the package is oriented horizontally.

Figure 2:
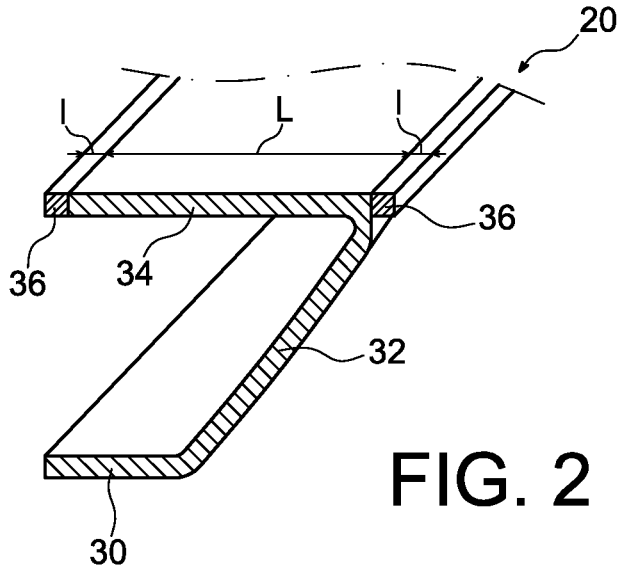
FIG. 2 shows a more detailed view in perspective of one of the thermal conduction elements of the package, also the subject matter of the present invention.

With reference now to FIG. 2, one of the thermal conduction elements 20 can be seen, taking the form of a profile with a cross-section in the general shape of a U lying on one of its two arms intended to contact the external surface of the lateral body of the package.

The arm of the U in question forms an internal radial part 30 of the element 20. It is connected at one of its ends to one end of an intermediate part 32 forming the base of the U, the other end of which is connected to an external part 34 forming the other arm of the U. This external part 34 is intended to form a portion of the external envelope of the package, mentioned above.

The internal, external and intermediate parts of each element 20 are produced from copper or one of the alloys thereof, for example in a single piece.

One of the particularities of the present invention lies in the fact that the external part 34 is equipped, at each of its two opposite ends, with an area 36 for connection by welding to another thermal conduction element, each connection area 36 being produced from steel, preferably stainless steel.

Each area 36 takes the form of a bar extending over the entire length of the profile 20, over a circumferential length appreciably less than that of the external part. Thus provision has preferentially been made for the circumferential length "l" of each area 36 to be between 5% and 15% of the circumferential length "L" of the external part 34.

One of the two connection areas 36 extends the free end of the arm of the U 34, while the other area 36 extends from the angle formed by this same arm 34 and the base of the U.

Figure 3:
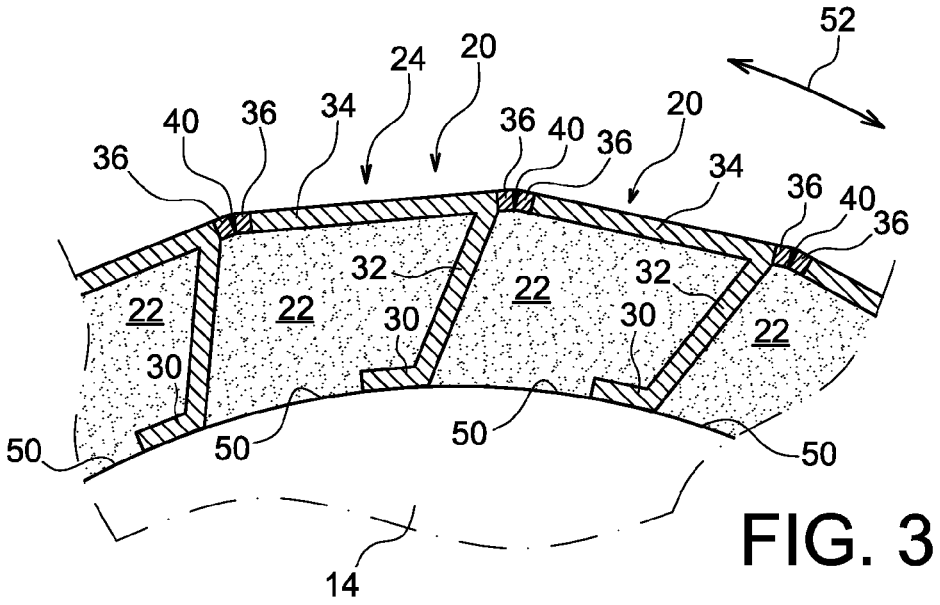
FIG. 3 shows a view in transverse section showing a part of the package shown in FIG. 1.

With reference to FIG. 3, it can be seen that the thermal conduction elements 20 are fixed to the lateral package body 14 by their internal part 30, for example by welding or bolting, a surface contact here being favoured so as to obtain good heat transfer. The elements 20 are also fixed end to end by welding of the facing connection areas 36. The welds 40 obtained are of the steel-steel type, carried out at a temperature of approximately 180° C. Preferably, no anticorrosion treatment is required on these welds 40, in particular when the areas 36 are produced from stainless steel.

Thus the external envelope 24 of the package is formed by the external parts 34, the connection areas 36 and the welds 40.

The thermal conduction elements 20 define in pairs cavities in which the radiological protection blocks 22 are housed. More precisely, each cavity 50 is delimited radially towards the inside by the internal part 30 of a first element 20 and by a part of the external surface of the body 14 of the package. It is delimited radially towards the outside by the external part 34 of this same first element 20, as well as by the connection area 36 provided at the free end of this arm 34. The radial delimitation towards the outside is also provided by the connection area 36 of a second conduction element 20, and by the weld 40 connecting it to the aforementioned area 36 belonging to the first element. Each cavity 50 is moreover delimited in the circumferential direction 52, in both directions, respectively by the intermediate parts 32 of the first and second conduction elements 20.

Finally, the cavities 50 are closed at their longitudinal ends by the structure of the damping rings 60 shown in FIG. 1.

Figure 3A:
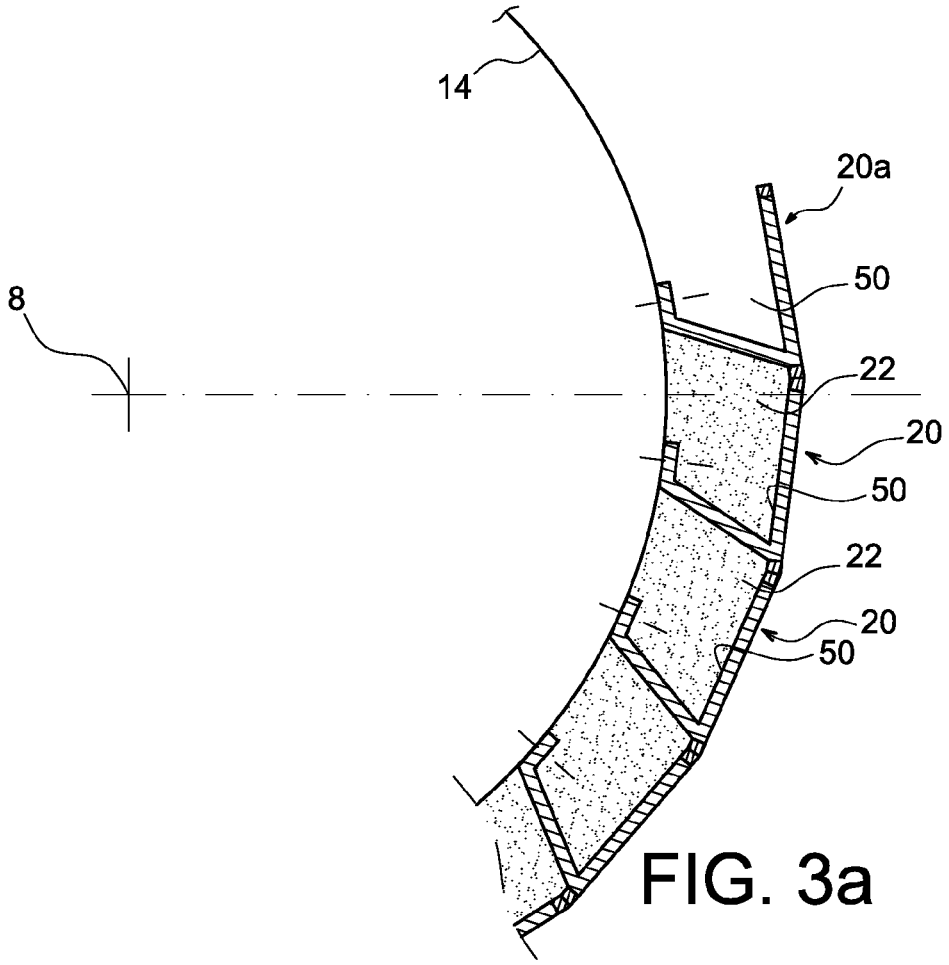
FIGS. 3*a* to 3*c* show various steps of a method of manufacturing a package shown in the previous figures, according to a first preferred embodiment of the invention.
Figure 3B:
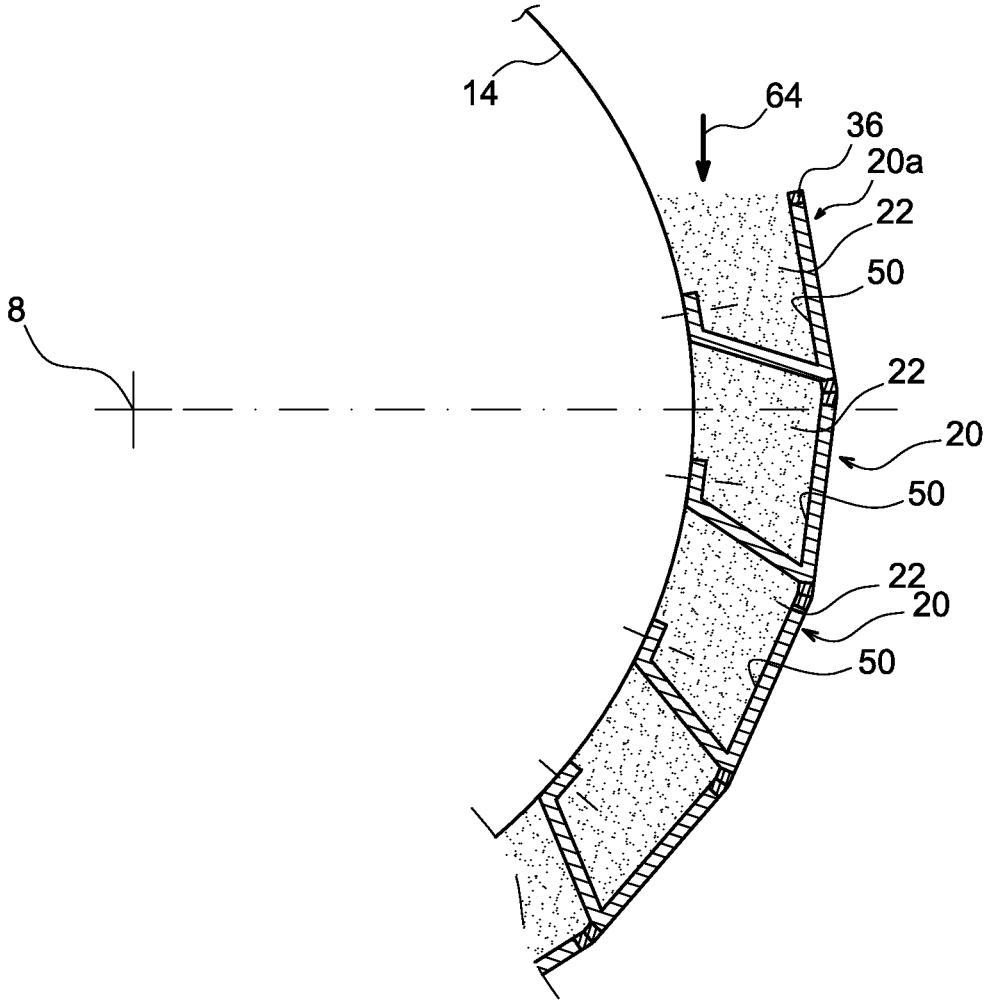
Figure 3C:
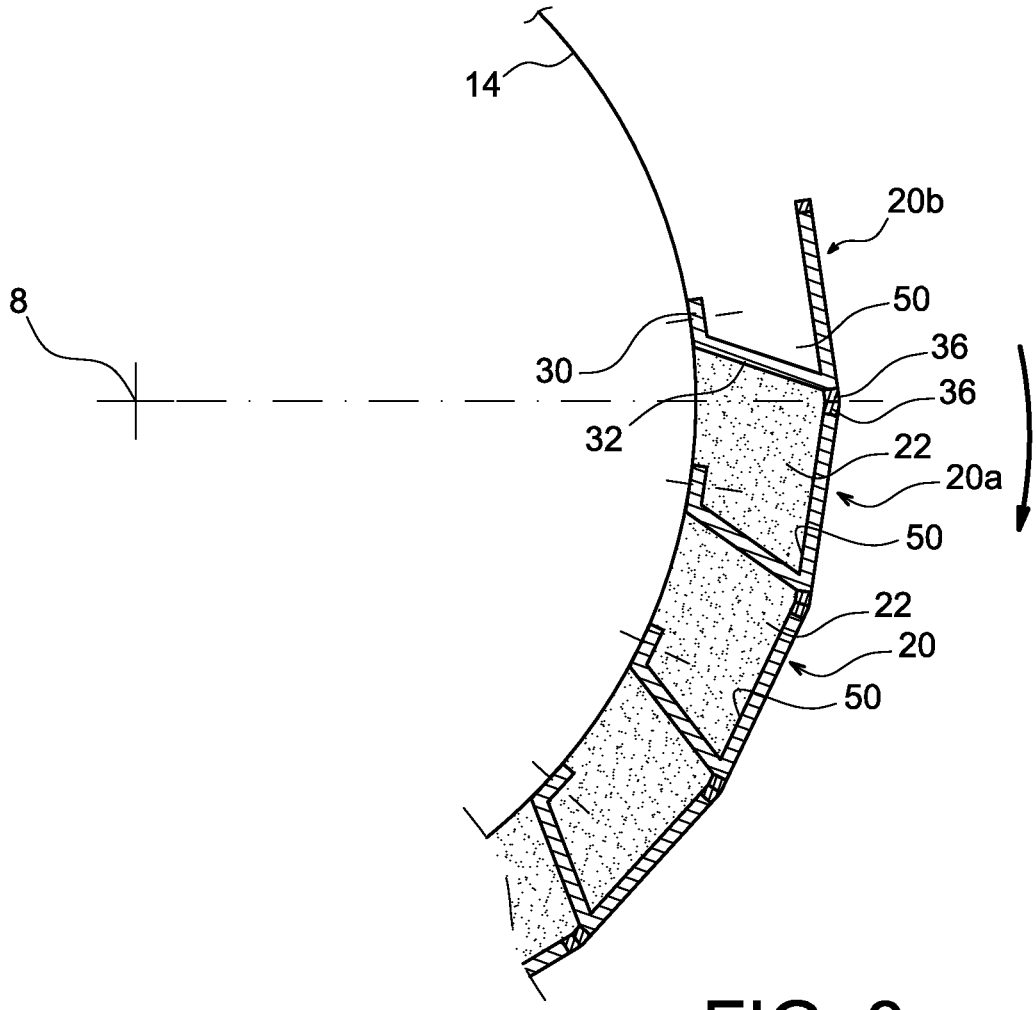

With reference now to FIGS. 3*a* to 3*c*, various steps of a method for manufacturing a package 2 described above are shown, according to a first preferred embodiment of the invention.

In this first embodiment, as well as in the following ones, the cavities 50 are filled successively, one by one and from above, with the package 2 oriented horizontally.

The package is then positioned so that the last conduction element 20*a* that has just been assembled on the lateral body 14 is open substantially vertically upwards, the U therefore being substantially straight. At this instant shown in FIG. 3*a*, the cavity 50, open towards the top, is empty. Moreover, the other conduction element, intended to close this cavity, is not yet assembled on the package.

The cavity 50 is then filled by pouring a neutron protection material, such as resin. This pouring, shown schematically by the arrow 64 in FIG. 3*b*, takes place directly in the space delimited by the first element 20*a* and by the damping rings of the package, by placing the pouring machine (not shown) above this space to be filled. The material emerging from the machine can therefore flow directly, by gravity, into the dedicated space, passing through the opening defined between the two free ends of the arms of the U. This pouring takes place preferentially at several material-ejection points, distributed along the longitudinal direction of the package.

The pouring is stopped when the required filling level is reached in the cavity 50, this level preferentially being on or close to the top connection area 36 of the element 20*a*.

The pouring machine is then removed, while the poured material solidifies by polymerisation in the cavity 50. Once the solid block has been obtained, it is easily possible to carry out a visual check thereon over its entire length, at the free top surface of the block, oriented horizontally upwards. The visual check on the quality of the neutron protection material consists for example of checking, after solidification, that there are no emerging cracks in the material, these cracks being able to result from a polymerisation problem related to poor control of the temperature during the pouring step, or a problem with the proportion of the mixing of the material.

After the inspection of the block, the second conduction element 20*b* is assembled on the package, by screwing or welding of its internal part 30 on the lateral body, as can be seen in FIG. 3*c*. Its intermediate part 32 closes off the cavity 50, and its bottom connection area 36 comes opposite the top connection area 36 of the first element 20*a*, contact optionally taking place between these two areas.

The package is then rotated about this axis 8 in order to suitably orient the second conduction element 20*b* and so as to be able to fill it in a manner identical to that which has just been described.

This succession of operations is then reiterated as many times as necessary to cover the whole of the lateral package body 14 with the conduction elements 20 and blocks 22. Moreover, it is preferentially only after the formation of all the blocks 22 that the welding of the connection areas 36 is carried out, in pairs. This makes it possible in particular to produce the welds in an order different from the one in which they follow each other in the circumferential direction.

Figure 4A:
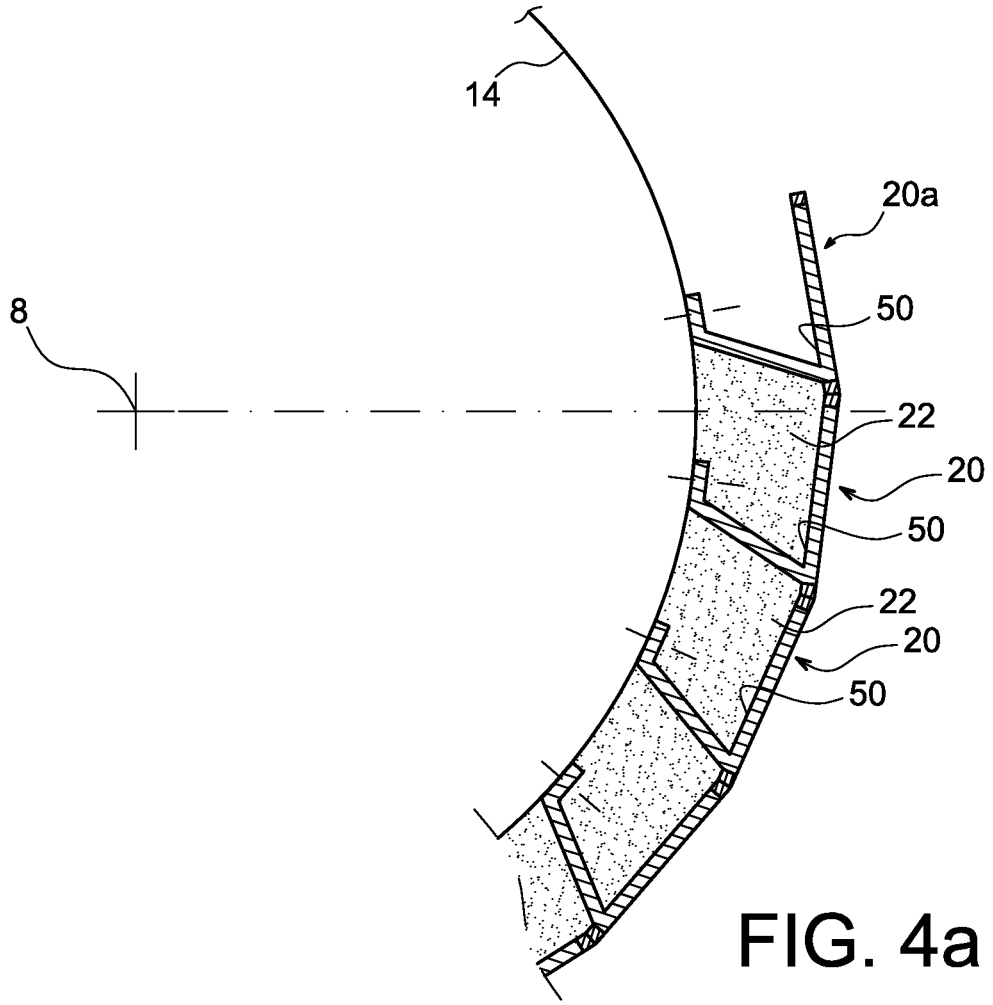
FIGS. 4*a* to 4*c* show various steps of a method for manufacturing the package shown in FIGS. 1 to 3, according to a second preferred embodiment of the invention.
Figure 4B:
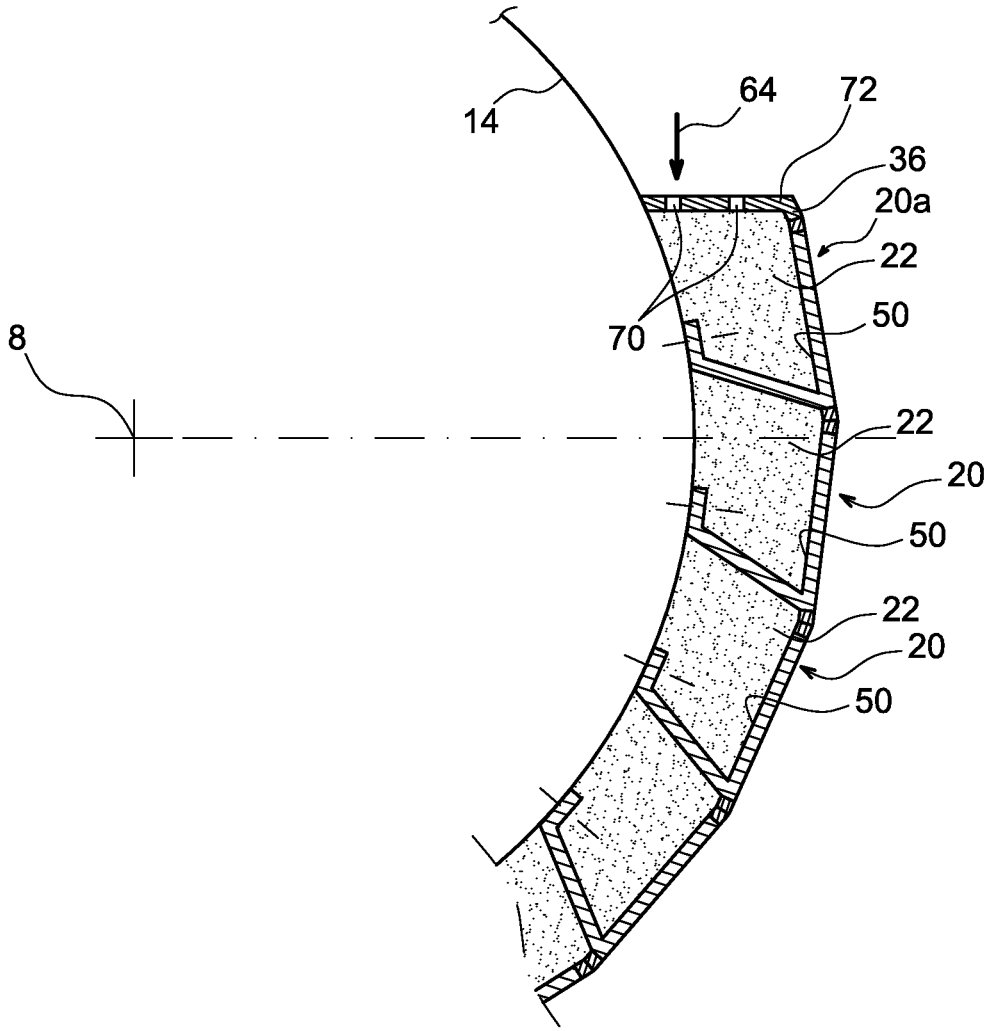
Figure 4C:
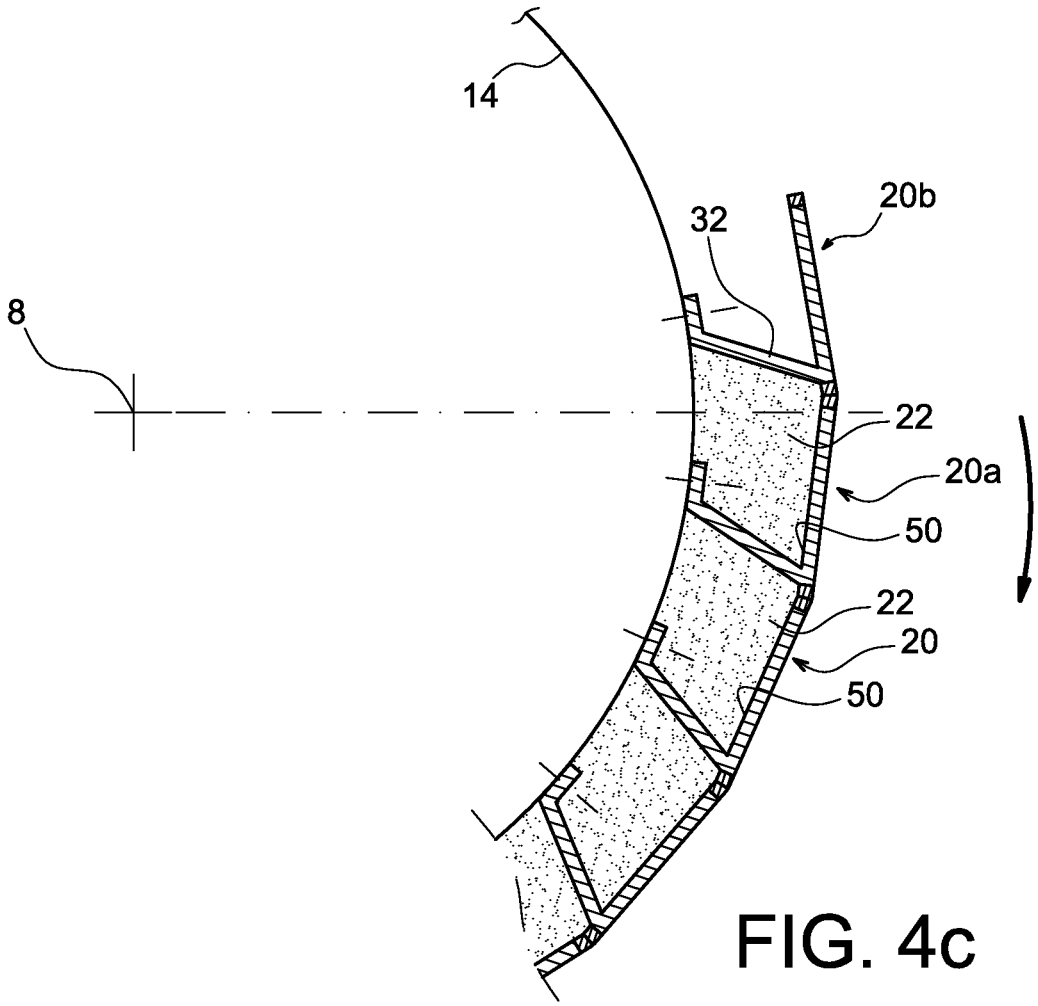

With reference now to FIGS. 4*a* to 4*c*, various steps of a method for manufacturing the package 2 described above are shown, according to a second preferred embodiment of the invention.

The first step still consists of positioning the package so that the last conduction element 20*a* that has just been assembled on the lateral body 14 is open substantially vertically upwards, the U therefore being substantially straight. At this instant shown in FIG. 4*a*, the cavity 50, open towards the top, is empty. Moreover, the other conduction element, intended to close this cavity, is not yet assembled on the package.

The cavity 50 is then filled, not by direct pouring into the space delimited by the first element 20*a*, but by passing through the orifices 70 formed through a tool 72 mounted above the element 20*a*, for example by resting on the top connection area 36, as shown schematically in FIG. 4*b*. The pouring machine therefore makes it possible to introduce the material into the cavity temporarily closed by the tool, through the orifices 70 formed in this tool 72, preferably distributed in the longitudinal direction. The pouring, shown schematically by the arrow 64 in FIG. 4*b*, is stopped when the required filling level is reached in the cavity 50. In this regard, other orifices can be formed through the tool 72, so as to constitute "overflow" orifices provisionally indicating to the operator the moment at which filling is finished.

The pouring machine and the tool are then removed, while the poured material solidifies in the cavity 50. Once the solid block has been obtained and the visual check thereon performed, the second conduction element 20*b* is assembled on the package, by screwing or welding of its internal part 30 on the lateral body, as can be seen in FIG. 4*c*, in a similar manner to that described for the first preferred embodiment.

Figure 5A:
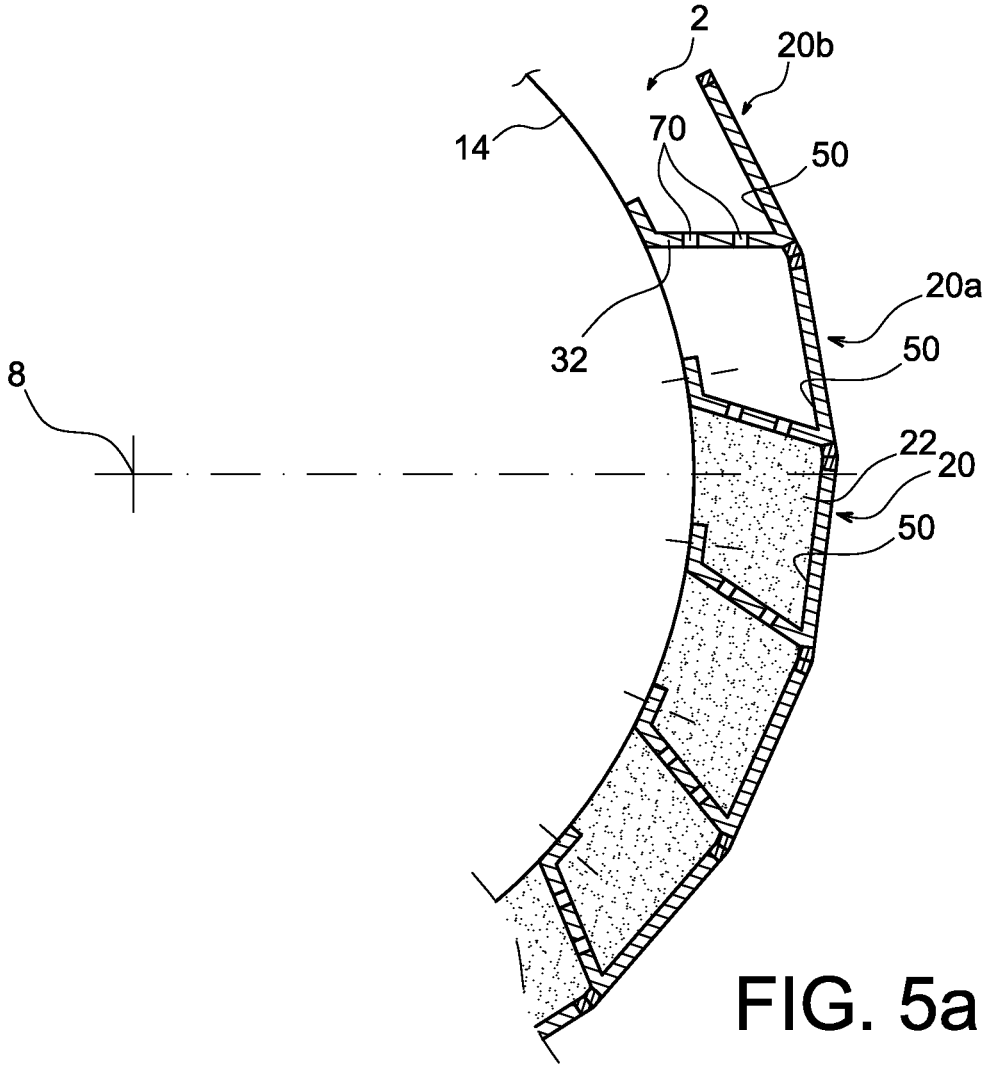
FIGS. 5*a* and 5*b* show various steps of a method for manufacturing the package shown in FIGS. 1 to 3, according to a third preferred embodiment of the invention.
Figure 5B:
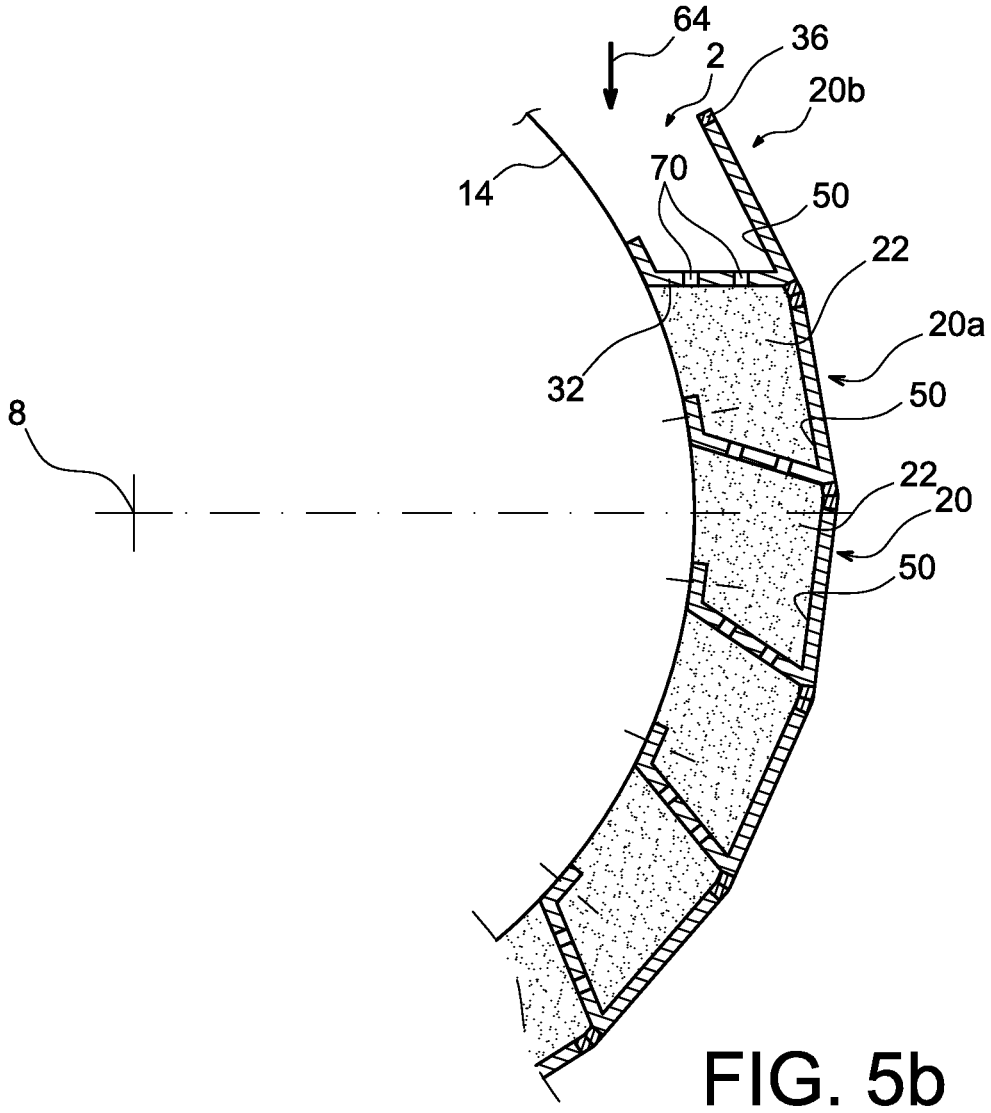

Finally, in the third preferred embodiment shown in FIGS. 5*a* and 5*b*, the tool is replaced by the second conduction element 20*b*, which is therefore installed temporarily on the package 2 during the pouring 64, which takes place through orifices 70 provided in the intermediate part 32 of this conduction element 20*b*.

At the end of pouring 64, the second element 20*b* is removed, for example after having been mounted temporarily by partial bolting on the lateral body 14, and then the inspection of the block is carried out. Next, the second conduction element 20*b* is reassembled definitively on the lateral body, still by bolting or welding.

Figure 6:
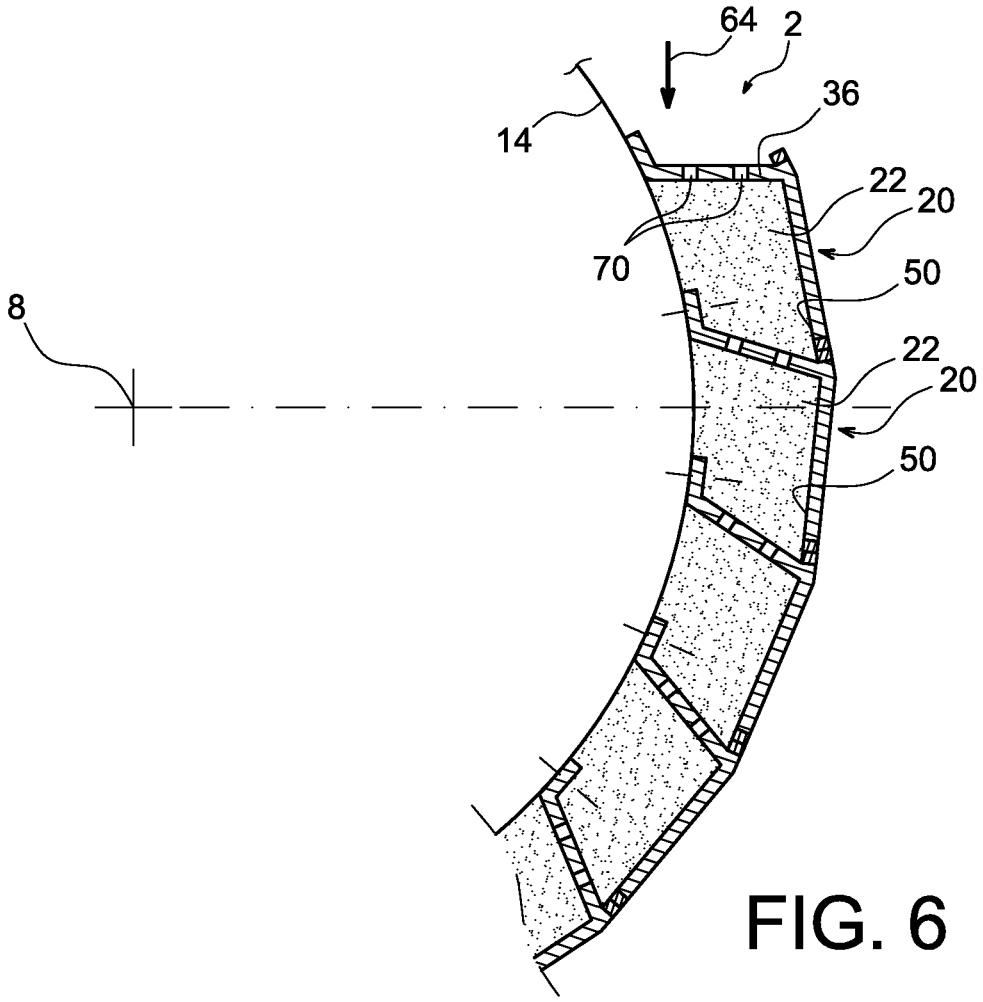
FIG. 6 shows a view similar to the one in FIG. 5*a*, according to an alternative embodiment.

According to a variant of this third embodiment, also applicable to the second method, the thermal conduction elements 20 take a cross section roughly in the form of an S, rather than a U. This variant is shown in FIG. 6.

Naturally, various modifications can be made by a person skilled in the art to the invention that has just been described, solely by way of non-limitative examples.

The invention claimed is:

1. A thermal conduction element (20) for a package holding radiological protection means (22) for transporting and/or storing radioactive materials, the element (20) comprising:

an internal part (30) in contact with a lateral body (14) of the package;

an external part (34) forming a portion of an external envelope (24) of said package; and an intermediate part (32) connecting the internal part to the external part, wherein the internal, external and intermediate parts are integrally formed from copper and one of the alloys thereof, and wherein steel connection areas (36) are positioned at two opposite ends of said external part (34), each of the steel connection areas (36) being welded to a steel connection area positioned on an external part of an adjacent thermal conduction element, the welded steel connection areas being configured to connect the external part (34) of the thermal conduction element (20) to external parts of adjacent thermal conduction elements.

2. The thermal conduction element according to claim 1, wherein each connection area (36) is produced from carbon steel or stainless steel.

3. The thermal conduction element according to claim 1, further comprising a transverse section roughly in the shape of a U or S.

4. The thermal conduction element according to claim 1, wherein each steel connection area (36) extends over a circumferential length (l) lying between 5% and 15% of the circumferential length (L) of its associated external part.

5. A package (2) holding radiological protection means (22) (2) for transporting and/or storing radioactive materials, further comprising a plurality of thermal conduction elements (20) corresponding to the thermal conduction element (20) and the adjacent thermal conduction elements of claim 1.

6. The package according to claim 5, wherein any adjacent two of the thermal conduction elements (20) define a cavity (50) housing the radiological protection means (22).

7. A method for manufacturing a package (2) holding radiological protection means (22) for transporting and/or storing radioactive materials, the package (2) comprising a lateral body 14) and a plurality of thermal conduction elements (20), each of the thermal conduction elements (20) comprising an internal part (30), an external part (34), and an intermediate part (32), the internal part (30) being in contact with the lateral body (14) of the package (2), the external part (34) forming a portion of an external envelope (24) of said package (2), the intermediate part (32) connecting the internal part (30) to the external part (34), the internal, external, and intermediate parts being integrally formed from copper and one of the alloys thereof, where steel connection areas (36) are positioned at two opposite ends of said external part (34), each of the steel connection areas (36) being welded to a steel connection area positioned on an external part of an adjacent one of the thermal conduction elements, the welded steel connection areas being configured to connect the external part (34) of the thermal conduction element (20) to external parts of adjacent ones of the thermal conduction elements, the method comprising pouring a radiological protection material into one of two of the thermal conduction elements (20*a*) defining a cavity (50) in which the radiological protection means (22) is to be housed, the pouring being carried out with the one thermal conduction element (20*a*) being assembled on the package (2).

8. The method according to claim 7, further comprising successively assembling the other one of the two of the thermal conduction elements (20*b*).

9. The method according to claim 8, wherein said cavities (50) are filled successively, one by one, with said package oriented horizontally and by introducing the radiological protection material from above.

10. The method according to claim 9, wherein the pouring of the radiological protection material takes place directly in said one of said two of the thermal conduction elements (20*a*) defining the cavity in which said radiological protection means (22) is being housed.

11. The method according to claim 9, wherein the pouring of the radiological protection material takes place through at least one orifice (70) provided on a tool (72) mounted above said one of said two of the thermal conduction elements (20*a*) defining the cavity (50) in which said radiological protection means (22) is housed, the other one of said two of the thermal conduction elements (20*b*) being assembled on the package after the removal of said tool (72).

12. The method according to claim 10, wherein the pouring of the radiological protection material takes place through at least one orifice (70) provided on the intermediate part (32) of said other one of said two of the thermal conduction elements (20*b*), mounted temporarily above said one of said two of the thermal conduction elements (20*a*) defining the cavity (50) in which said means (22) is housed, the other of said two of the thermal conduction elements (20*b*) then being removed and then reassembled definitively on the package.

13. The method according to claim 12, wherein welding of the steel connection areas (36) in pairs is carried out after the radiological protection means (22) of the package has been poured in the cavity (50) respectively associated with the thermal conduction elements (20) on which the pairs of the steel connection areas (36) are disposed.

* * * * *